US005516416A

United States Patent [19]

Canaperi et al.

[11] Patent Number: 5,516,416

[45] Date of Patent: May 14, 1996

[54] APPARATUS AND METHOD FOR ELECTROPLATING PIN GRID ARRAY PACKAGING MODULES

[75] Inventors: Donald F. Canaperi, Bridgewater, Conn.; Kim H. Ruffing, Briarcliff Manor, N.Y.

[73] Assignee: International Business Machines Corporation, Yorktown Heights, N.Y.

[21] Appl. No.: 355,740

[22] Filed: Dec. 14, 1994

[51] Int. Cl.[6] ..... C25D 7/12; C25D 17/06; C25D 21/00

[52] U.S. Cl. ..... 205/78; 205/123; 205/125; 204/224 R; 204/297 R; 204/297 W

[58] Field of Search ..... 204/297 R, 297 W, 204/224 R; 205/78, 125, 123

[56] References Cited

U.S. PATENT DOCUMENTS

| | | | |
|---|---|---|---|
| 2,861,936 | 11/1958 | Colasanto | 204/297 W X |
| 3,043,767 | 7/1962 | Tobey | 204/297 W |
| 3,658,663 | 4/1972 | Fukanuma et al. | 204/297 W X |
| 3,719,566 | 3/1973 | King et al. | 205/125 |
| 4,312,716 | 1/1982 | Maschler et al. | 204/297 W X |
| 4,508,611 | 4/1985 | Johnson et al. | 204/202 |
| 4,914,813 | 4/1990 | Layher et al. | 29/843 |
| 5,022,976 | 6/1991 | Röll et al. | 204/297 R |
| 5,087,331 | 2/1992 | Roll et al. | 205/118 |
| 5,240,588 | 8/1993 | Uchida | 205/125 |

OTHER PUBLICATIONS

"Electroplating Important In Manufacturing Cofired Multilayer Ceramic Modules and Packages", R. Sisolak, Electri-.Onics, Sep., 1983, pp. 25–26.

"Prototype Packages In Aluminum Nitride For High Performance Electronic Systems", K. J. Lodge, J. A. Sparrow, E. D. Perry, E. A. Logan, M. T. Goosey, D. J. Pedder and C. Montgomery, Proceedings of the 40th Electronic Components vol. 1 and Technology Conference.

"High Speed Electrical Characterization and Simulation Of a Pin Grid Array Package", T. W. Goodman, H. Fujita, Y. Murakami, A. T. Murphy, IEEE, 1993, 1993 Japan Int'l. Electronics Manufacturing Technology Symposium.

"CoFired Metallized Ceramic Technology And Fabrication Using Electroless Plating", B. Hassler, Proceedings of International Symposium on Microelectronics, 741–748, (1986).

"Development of A Cost Effective High Performance Metal QFP Packaging System", D. Mahulikar, A. Pasqualoni and J. Crane, IEEE, 1993, pp. 405–411.

"An Aluminum Nitride Package for 300° C. Operation", T. Bloom, IEEE, 1993 pp. 431–435.

*Primary Examiner*—Donald R. Valentine
*Attorney, Agent, or Firm*—Barnes, Kisselle, Raisch, Choate, Whittemore & Hulbert

[57] ABSTRACT

An apparatus and a method for electroplating pin grid array (PGA) packaging modules by utilizing a compressible member and an electrically conductive foil for providing electrical connections to the pins such that all the critical areas of the pins, the wire bond pads, the seal band and the die cavity are electroplated simultaneously through the connection to the pins.

18 Claims, 2 Drawing Sheets

APPARATUS AND METHOD FOR ELECTROPLATING PIN GRID ARRAY PACKAGING MODULES

FIELD OF THE INVENTION

The present invention generally relates to an apparatus and a method for electroplating pin grid array (PGA) packaging modules and more particularly, relates to an apparatus and a method for electroplating PGA packaging modules by utilizing a compressible member and an electrically conductive foil for providing electrical connection to the pins.

BACKGROUND OF THE INVENTION

In recent years, ceramic packaging modules with cavity die attach and gold wire bonding with PGA contacts have become increasingly popular as the single chip carriers for the I—486 family of microprocessors. Alumina is frequently the ceramic material chosen while molybdenum or tungsten is widely used in an alumina ceramic substrate as metallic conductors. In the manufacturing of a PGA packaging module, after a conventional nickel plating of Mo or W surface features is first conducted, Kovar pins are brazed onto the I/O pads with Cu—Ag or Ag as the typical brazing material. This pad/pin assembly must be protected from corrosion and wet electromigration with Ni/Au or Ni—Co/Au over—layers. For solderable modules, a thin layer of gold having a thickness between 600–1000 Å is used. For pluggable modules, typically a thickness of 2 μm is preferred. Additionally, the wire bond pads and the cavity die attach areas are also plated with Ni and Au to provide suitable metallurgy for Au or Ai wire bonding and Au—Si Si or JM 7000 epoxy die attach. The Au used should be 99.99% pure and conform to MIL. SPEC. 4520-C.

A key challenge in meeting the cost/performance requirements in packaging technology is to provide high density multi-layer interconnection capability with smaller wire bond pad spacing and smaller conductor widths while retaining the design flexibility to lower impedance to output pins. Electroless plating technology offers some unique advantages for the metallization of such structures. Since it does not require the ceramic circuitry to be shorted for electrical connection, it is unnecessary to have extra conductor lines routed to the edge of the substrate. This significantly simplifies the layout, reduces cross-talk due to extra conductor lines and eliminates the need to cut, grind and polish the laminated structures.

Despite the advantages offered by the electroless plating technology, the process is not necessarily suitable for all substrate materials. For instance, in recent years, with the development of high performance and high wattage chips, substrate materials that have higher capacity for heat dissipation such as aluminum nitride (AIN) have become more attractive materials. However, AIN is sensitive to highly alkaline electroless Au plating solutions. It has been determined that AIN is incompatible with solutions that have a pH above 9. While certain electroless Au processes based on sulfite plating solution chemistry operate at pH levels below 9 and are commercially available, these processes were found to provide poor quality of gold metallurgy and furthermore, building sufficiently thick deposits of between 1–2 μm Au with good adhesion was not possible due to the extremely low plating rates after the initial deposition of Au associated with Ni dissolution. Most electrolytic Au plating processes work at pH levels below 9 and provide excellent quality of metallurgy. It is highly desirable to have an electrolytic plating process that retains the advantages of design flexibility and also eliminates the need for bus bars and cutting, grinding and polishing operations.

Earlier works on the development of electroplating technology for the fabrication of ceramic packages are based on extending the conductor lines to the edge of the substrate, application of conducting pastes or bending the pins so that electrical contact could be made using metal strips and/or bars. For instance, see R. Sisolak, Electronics 9 (1983) p. 25. Other workers, for instance, Fulinara et al, in U.S. Pat. No. 4,914,813 describe a method in which the metal conductor lines are extended to the sides. These lines are interconnected by applying a conductive Ag-acrylic paste to the outer edges of the substrate to provide electrical connection common to all the bond paths, cavity die area and the pins. However, this method not only increases process complexity but also does not address the cross-talk problems due to extra lines. Johnson, et al, U.S. Pat. No. 4,508,611 discloses a method that is based on bending the lead frames so that they can be mounted on a conducting moving belt. This technique applies specifically to lead frame applications and cannot be used for PGA packages. King, et al, U.S. Pat. No. 3,719,566 discloses a process for plating wire bond and I/O pads in a flat ceramic package. The method involves fabricating a glass ceramic seal and then plating the uncovered area. Electrical contact is made by a frame that is bent on the sides and pressed against the pads. The design of a jig for plating PGA has been disclosed by Röll et al. in U.S. Pat. No. 5,087,331. In his method, the pins are pre-bent in a pre-bending jig and then clipped onto a receiving jig. Electrical contact with all the pins is made by means of round or wedge-shaped metal bars or pegs clamped between pins. The bars/pegs are mounted on a metal plate arranged at right angles to the pins. The jig cannot be used with PGA modules that have unbent pins.

It is therefore an object of the present invention to provide an apparatus and method for electroplating PGA packaging modules that does not have the drawbacks of the prior art methods.

It is another object of the present invention to provide an apparatus and method for electroplating PGA packaging modules that provides high density multi-layer interconnection capability with smaller wire bond pad spacing and smaller conductor width.

It is a further object of the present invention to provide an apparatus and method for electroplating PGA packaging modules that provides smaller conductor width while retaining the design flexibility to lower the impedance to output pins.

It is another further object of the present invention to provide an apparatus and method for electroplating PGA packaging modules that allows design flexibility and simplification of the circuit layout.

It is yet another object of the present invention to provide an apparatus and method for electroplating PGA packaging modules that retains design flexibility and eliminates the need for bus bars and the cutting, grinding and polishing operations.

It is yet another further object of the present invention to provide an apparatus and method for electroplating PGA packaging modules that meets the challenge in cost/performance requirements in packaging technology for semiconductor chips.

It is still another object of the present invention to provide an apparatus and method for electroplating PGA packaging modules including cavity PGA modules and non-cavity PGA modules by utilizing a compressible member and an electrically conductive foil to provide electrical connection to the pins.

SUMMARY OF THE INVENTION

In accordance with the present invention, an improved apparatus and method for electroplating PGA packaging modules by conducting a current through the pins on the module such that the pins, the wire bond pads, the seal band and the die cavity can be plated simultaneously with nickel, gold or other metals is provided.

In a preferred embodiment, an improved apparatus for electroplating PGA packaging modules is provided by utilizing a rigid backing member, a compressible member positioned next to the rigid backing member, an electrically conductive member positioned between the compressible member and the pins on the PGA module, and a pressurizing device capable of clamping all the members together to a sufficiently high pressure such that when an electrical current is applied to the conductive member, the current flows to substantially all of the pins on the PGA module. Through internal connections, the current flows simultaneously through the pins to the wire bond pads, the seal band and the die cavity.

In an alternate embodiment, an improved apparatus for electroplating a PGA packaging module equipped with pins is provided by utilizing a rigid backing member, a compressible member that has at least one electrically conductive surface and is positioned next to the rigid backing member with the at least one electrically conductive surface positioned facing away from the rigid backing member, and a pressurizing device capable of clamping the members together to a sufficiently high pressure such that when an electrical current is applied to the at least one conductive surface, the current flows to substantially all of the pins, the wire bond pads, the seal band and the die cavity of the PGA module. The electrically conductive surface on the compressible member can be formed by either coating the surface of the member with an electrically conductive coating, or by laminating an electrically conductive film to the surface of the compressible member.

The present invention is further directed to an improved method of electroplating a PGA packaging module equipped with pins by first clamping together a rigid backing member, a compressible member that has at least one electrically conductive surface facing away from the backing member, and a PGA module equipped with pins positioned with the pins contacting the at least one electrically conductive surface on the compressible member in a pressurizing device to a sufficiently high pressure such that when an electrical current is applied to the at least one electrically conductive surface in a plating bath solution, the current flows to substantially all the pins, the wire band pads, the seal band and the die cavity of the PGA module simultaneously.

BRIEF DESCRIPTION OF THE DRAWINGS

Other objects, features and advantages of the present invention will become apparent upon consideration of the specification and the appended drawings, in which.

DETAILED DESCRIPTION OF THE PREFERRED AND THE ALTERNATE EMBODIMENTS

The present invention discloses an apparatus and a method for electroplating a PGA packaging module that provides improved electrical conductance to all the pins on the module by utilizing an electrically conductive foil and a compressible member of an elastomeric sheet.

Figure 1:
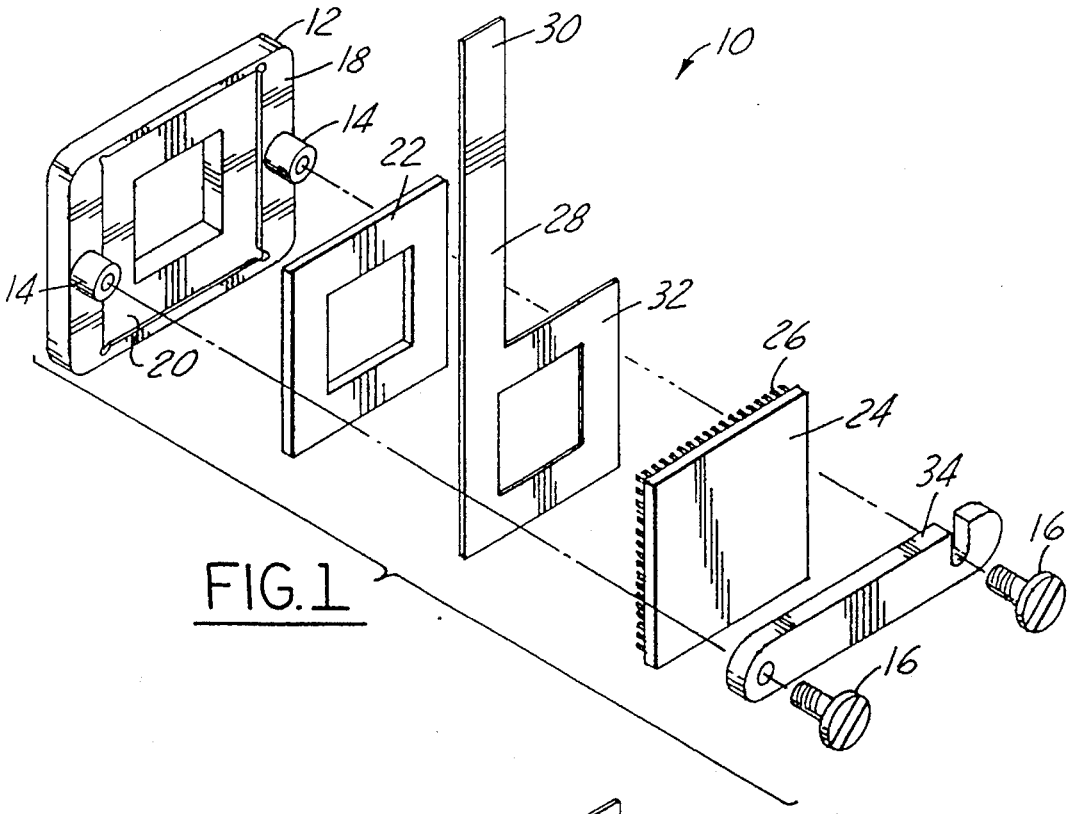
FIG. 1 is a perspective view of the various components of the present invention apparatus and a PGA module.

Referring initially to FIG. 1, where it is shown the present invention apparatus 10 in a preferred embodiment. In this embodiment, a rigid backing plate 12 equipped with bosses 14 for fastening is first provided. The rigid backing plate 12 can be made of a metal material such as steel or other rigid materials that are chemically resistant to the plating bath solutions. The bosses 14 are internally threaded to receive fastening bolts 16 and to allow the adjustment of pressure. As shown in FIG. 1, the inner surface 18 of the rigid plate member 12 is provided with an indented area 20 to facilitate the positioning of a compressible member 22.

The compressible member 22 can be made of an elastomeric material or any other compressible material that is suitable for the present invention. When an elastomeric material is used, the material is chosen such that it is resistant to the chemical plating solution which the compressible member is exposed to. For instance, it has been found that a suitable elastomeric material is an Ethylene-Propylene-Dienemonomer rubber, a fluorosilicone rubber or a silicone rubber. The compressibility of the material should be such that when a predetermined pressure is applied on the PGA module 24, all the pins 26 make good electrical contact with the foil 28 without excessive deformation of the pins 26 or puncturing of the conductive foil 28. It has been found that when anyone of the three above-described elastomeric materials is used, a suitable compressibility can be expressed in a Durometer "A" hardness reading of between about 30 and about 100. The thickness of the elastomeric sheet is generally maintained in the range between about 1 mm and about 6 mm. Other compressible materials that have the suitable compressibility and the necessary chemical resistance to plating solutions can also be used.

The electrically conductive foil 28 used between the compressible member 22 and the PGA module 24 should be made of a material that is sufficiently strong but yet flexible such that, when an electrical current is fed in through the end 30 of the conductive foil 28 in a plating solution, the electrical current flow through the body portion 32 of the foil 28 into substantially all the pins 26 on module 24.

A pressurizing device 34, which is shown in FIG. 1 as a mechanical clamp, is used to clamp the three members together by bolts 16. The pressure exerted on the PGA module 24 can be adjusted through the clamping bolts 16 by tightening or loosening the bolts. It has been found that for a typical fixture that has a size slightly larger than the PGA module 24, i.e., 60 mm×60 mm, approximately between about 1 kg and about 10 kg force is applied on module 24 in order to achieve the optimum pressure range for a module having approximately 150–200 pins. For modules having lesser or more pins, the force applied can be adjusted proportionally. In the optimum pressure range, pins 26 are pressed onto the foil 28 against the compressible member 22 such that small indentations are made in the foil.

The selection of material for the foil 28 is important since the foil should be made of a material of sufficient strength but yet pliable such that it allows a predetermined amount of deformation against a backing of the compressible member 22. It has been found that some of the suitable foil materials are copper, stainless steel and beryllium-copper. A suitable thickness of the foil is between about 0.02 mm to about 0.2 mm.

Figure 2:
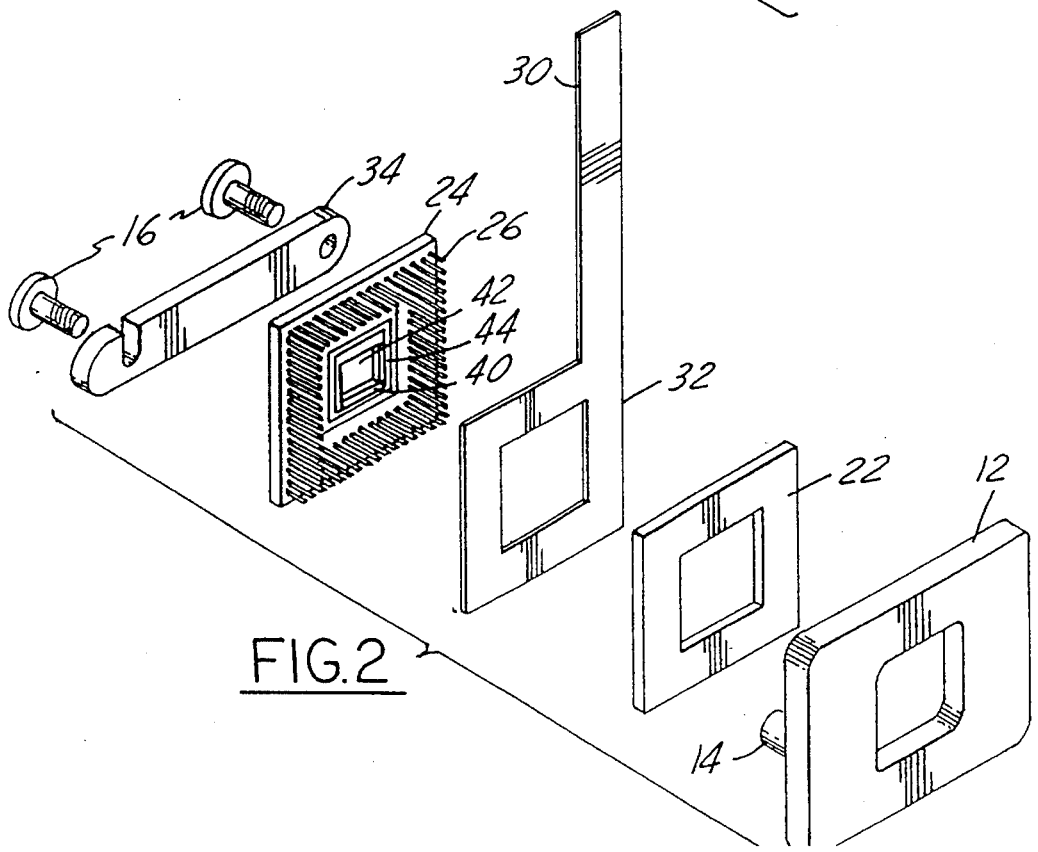
FIG. 2 is a perspective view of the various components of the present invention apparatus and a PGA module viewed from an opposite direction to that shown in FIG. 1.
Figure 3:
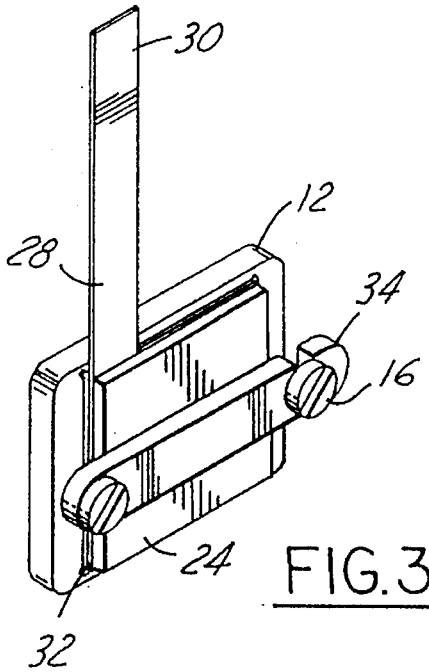
FIG. 3 is a perspective view of the present invention apparatus in an assembled and compressed state.

FIG. 2 is a perspective view of the various components of the present invention apparatus as shown in FIG. 1 but viewed from an opposite direction. A recessed area (or cavity) 40 in the PGA module 24 is shown which includes the wire bond pads (not shown) and the die cavity 42. A seal band 44 is shown which is used as a bonding site for a cap after a chip is wire bonded in the recessed area 40 to shield the area from moisture, dust or mechanical damages. FIG. 3 is a perspective view of the present invention apparatus shown in an assembled and compressed state.

Figure 4:
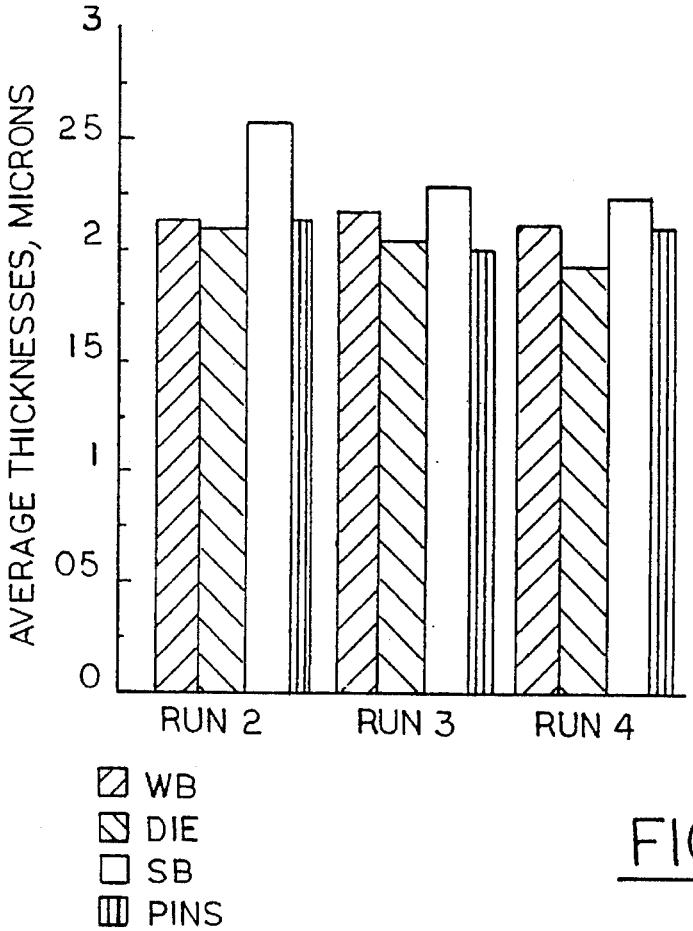
FIG. 4 is a graph showing the electroplating thickness uniformity obtained in three separate tests.

FIG. 4 is a graph showing the plating thickness uniformity of gold in various plating tests illustrating, generally, a good repeatability of the plating process utilizing the present invention apparatus. The thickness of the gold coating was measured on the wire bond pads, on the die cavity, on the seal band and on the pins. Five individual PGA modules were tested and averaged for each measurement. In the plating of gold, commercially available plating baths are used. A gold strike is first applied using a gold strike bath and then a heavy gold layer is plated on top using a heavy gold plating bath. The thickness of gold coatings shown in FIG. 4 is approximately 2 μm.

It should be noted that while the preferred embodiment shown in FIGS. 1–3 depicts an electroplating apparatus for a cavity PGA packaging module, the present invention is applicable to either a cavity-type or a non-cavity-type PGA packaging module.

In an alternate embodiment, the electrically conductive foil 28 and the compressible member 22 are combined into one unit. It can be made of a compressible material such as an elastomer and then either coated with an electrically conductive coating material or laminated with an electrically conductive metal foil. This embodiment provides the additional benefit that the handling of the apparatus is simplified since only one member, i.e. a compressible/electrically conductive member is needed. In this alternate embodiment, either one or both surfaces of the compressible member can be made electrically conductive.

In a second alternate embodiment, it is possible to utilize a conductive particle filled elastomeric material or other similarly conductive compressible material as the compressible member. The conductive particles render the material electrically conductive through the entire thickness of the compressible member. If it is desirable to maintain electrical isolation between the PGA module and the rigid backing plate, then a layer of insulating material can be placed between the conductive elastomer and the backing plate.

The present invention therefore discloses a method in which electrical contact to the cavity die area, the wire bond pads and the seal band is made through the pins. The metallization of all the critical features in a PGA module is therefore completed simultaneously. It is important that the compressibility of the elastomer and the flexibility of the electrically conducting foil ensure that all pin tips are contacted. A test conducted by using I-486 single chip modules with 168 pins indicated that a wide variety of elastomers and conducting foils are effective in making 100% electrical contact. The optimum clamping force needed to make good electrical contact without excessive deformation of the pins or puncturing of the conducting foil can be determined in a few trials. For "cavity down" packages, the backing plate, the elastomer sheet and the conducting foil should match the shape of the PGA module with a window over the cavity area so that sufficient mass transfer occurs right up to the cavity wall during plating. Suitable solution flow and mechanical agitation are used to reduce any non-uniformity in current distribution and the resulting plating thickness.

It should be noted that even though a mechanical clamping device is shown in the preferred embodiment, any other pressurizing device can be used to apply a uniform pressure on the pins of the PGA module against the compressible material backing. Furthermore, while a single module, i.e. a single PGA module, apparatus is shown in the preferred embodiment, any number of modules can be accommodated in a single apparatus to facilitate a high volume manufacturing process. For instance, apparatus that have 4 positions, 16 positions, and 24 positions for electroplating a multiple numbers of PGA modules have been successfully demonstrated.

While the present invention has been described in an illustrative manner, it should be understood that the terminology used is intended to be in a nature of words of description rather than of limitation.

Furthermore, while the present invention has been described-in terms of a preferred and two alternate embodiments thereof, it is to be appreciated that those skilled in the art will readily be able to apply these teachings to other possible variations of the invention.

The embodiments of the invention in which an exclusive property or privilege is claimed are defined as follows:

What is claimed is:

1. An apparatus for electroplating a pin grid array module equipped with a multiplicity of pins comprising:

a rigid backing member, a compressible member positioned next to said rigid backing member, an electrically conductive member positioned between said compressible member and said pins on the pin grid array module when installed in place, and a pressurizing device capable of clamping said rigid backing member, said compressible member, said electrically conductive member and said pin grid array module when installed in place together with pins contacting said conductive member to a pressure sufficiently high such that when an electrical current is applied to said conductive member it flows to substantially all the pins on said pin grid array module.

2. An apparatus according to claim 1, wherein said compressible member being made of an elastomeric material.

3. An apparatus according to claim 1, wherein said pressurizing device being a mechanical clamp.

4. An apparatus according to claim 1, wherein said compressible member being made of an elastomeric material selected from the group consisting of Ethylene-Propylene-Dienomonomer rubber, fluorosilicone rubber and silicone rubber.

5. An apparatus according to claim 1, wherein said compressible member having a Durometer "A" hardness reading of between about 30 and about 100.

6. An apparatus for electroplating a pin grid array module equipped with a multiplicity of pins comprising:

a rigid backing member, a compressible member positioned next to said rigid backing member, an electrically conductive member of a metal foil or a foil coated with conductive metal particles positioned between said compressible member and said pins on the pin grid array module when installed in place, and a pressurizing device capable of clamping said rigid backing member, said compressible member, said electrically conductive member and said pin grid array module when installed in place together with pins contacting said conductive member to a pressure sufficiently high such that when an electrical current is applied to said conductive member it flows to substantially all of the pins on said pin grid array module.

7. An apparatus according to claim 6, wherein said pin grid array module when installed in place is further equipped with a multiplicity of wire bond pads, a seal band and a die cavity which are electroplated simultaneously with said multiplicity of pins.

8. An apparatus according to claim 6, wherein said a metal foil is selected from the group consisting of copper foil, stainless steel foil, beryllium-copper foil and any other suitable metal foil.

9. An apparatus according to claim 6, wherein said rigid backing member further comprises an opening positioned corresponding to a cavity on said pin grid array module when installed in place to improve solution flow and current distribution at die cavity, wire bond pads and seal band.

10. An apparatus for electroplating a pin grid array module equipped with pins comprising:

a rigid backing member, a compressible member having at least one electrically conductive surface, said member being positioned next to said rigid backing member with said at least one electrically conductive surface facing away from said rigid backing member, and a pressurizing device capable of clamping said rigid backing member, said compressible member and said pin grid array module when installed in place together in such a way that the pins on said pin grid array module are facing said at least one electrically conductive surface and at such a pressure that is sufficiently high such that when an electrical current is applied to said at least one conductive surface the current flows to substantially all the pins on said pin grid array module.

11. An apparatus according to claim 10, wherein said pressurizing device being a mechanical clamp.

12. An apparatus for electroplating a pin grid array module equipped with pins comprising:

a rigid backing member a compressible sheet having an electrically conductive coating applied on at least one of its two surfaces, said sheet being positioned next to said rigid backing member with said at least one electrically conductive surface facing away from said rigid backing member, and a pressurizing device capable of clamping said rigid backing member, said compressible sheet and said pin grid array module when installed in place together in such a way that the pins on said pin grid array module are facing said at least one electrically conductive surface and at such a pressure that is sufficiently high such that when an electrical current is applied to said at least one conductive surface the current flows substantially all of the pins on said pin grid array module.

13. An apparatus according to claim 12, wherein said compressible member having at least one electrically conductive surface is a compressible sheet having an electrically conductive sheet laminated to at least one of its two surfaces.

14. An apparatus according to claim 12, wherein said compressible member is made of a material having an elastic behavior and is filled with electrically conductive particles such that electrical conductivity exists in the entire thickness of the compressible member.

15. A method of electroplating a pin grid array module equipped with pins comprising the steps of:

providing a rigid backing member, providing a compressible member having at least one electrically conductive surface and positioning said compressible member next to said rigid backing member with said at least one electrically conductive surface away from said backing member, providing a cavity pin grid array module equipped with a multiplicity of pins, providing a pressurizing device capable of clamping said rigid backing member, said compressible member and said pin grid array module together in such a way that the pins on said pin grid array module are contacting said at least one electrically conductive surface of said compressible member, pressurizing said rigid backing member, said compressible member and said pin grid array module that are positioned together forming an assembly to a sufficiently high pressure such that when an electrical current is applied to said at least one electrically conductive surface the current flows to substantially all the pins on said pin grid array module, and positioning said assembly in a plating bath and flowing an electrical current to said at least one electrically conductive surface on said compressible member.

16. A method of electroplating a pin grid array module equipped with pins comprising the steps of:

providing a rigid backing member, providing a compressible member which comprises an elastomeric member and an electrically conductive foil with the latter positioned facing the pins on said pin grid array module when installed in place, providing a cavity pin grid array module equipped with a multiplicity of pins, providing a pressurizing device capable of clamping said rigid backing member, said compressible member and said pin grid array module together in such a way that the pins on said pin grid array module are contacting said at least one electrically conductive surface of said compressible member, pressurizing said rigid backing member, said compressible member and said pin grid array module when installed in place that are positioned together forming an assembly to a sufficiently high pressure such that when an electrical current is applied to said at least one electrically conductive surface the current flows to substantially all the pins on said pin grid array module, and positioning said assembly in a plating bath and flowing an electrical current to said at least one electrically conductive surface on said compressible member.

17. A method according to claim 16, wherein said electrically conductive foil is a metal foil or a foil coated with conductive metal particles.

18. A method according to claim 16, wherein said elastomeric member having a Durometer "A" hardness of between about 30 and about 100.

* * * * *